US010665085B2

(12) United States Patent
Boyles

(10) Patent No.: US 10,665,085 B2
(45) Date of Patent: May 26, 2020

(54) SAFETY EVENT ALERT SYSTEM AND METHOD

(71) Applicant: Trimble Inc., Sunnyvale, CA (US)

(72) Inventor: Randy Boyles, Advance, NC (US)

(73) Assignee: Trimble Inc., Sunnyvale, CA (US)

( * ) Notice: Subject to any disclaimer, the term of this patent is extended or adjusted under 35 U.S.C. 154(b) by 908 days.

(21) Appl. No.: 14/066,590

(22) Filed: Oct. 29, 2013

(65) Prior Publication Data

US 2015/0116114 A1 Apr. 30, 2015

(51) Int. Cl.
*G08B 25/00* (2006.01)
*G08G 1/00* (2006.01)

(52) U.S. Cl.
CPC ..... *G08B 25/00* (2013.01); *G08G 1/20* (2013.01)

(58) Field of Classification Search
None
See application file for complete search history.

(56) References Cited

U.S. PATENT DOCUMENTS 6,308,120 B1 10/2001 Good
2004/0236476 A1 11/2004 Chowdhary
2006/0071766 A1* 4/2006 O'Brien ..... B60C 23/0408 340/442
2008/0255722 A1 10/2008 McClellan et al.
2010/0302066 A1* 12/2010 Talty ..... H04L 12/189 340/905
2011/0080282 A1* 4/2011 Kleve ..... H04M 11/04 340/539.11
2013/0007626 A1* 1/2013 Adams ..... G07C 5/008 715/738
2013/0104064 A1* 4/2013 McCormick ..... G06F 3/0484 715/765
2013/0241749 A1 9/2013 Schibler
2013/0338855 A1* 12/2013 Mason ..... G07C 5/0816 701/2

OTHER PUBLICATIONS

Telogis Supervisor, Mobile Fleet Management, printed from the internet (http://www.telogis.com/solutions/fleet/supervisor) on Jul. 25, 2013, 5 pages.
GPS Fleet Tracking System, printed from the internet (http://www.telogis.com/solutions/fleet/supervisor) on Jul. 25, 2013, 4 pages.

* cited by examiner

*Primary Examiner* — Curtis A Kuntz
*Assistant Examiner* — Shawna M Kingston
(74) *Attorney, Agent, or Firm* — Kilpatrick Townsend & Stockton LLP

(57) ABSTRACT

Systems and methods are directed to recording data at a plurality of in-service vehicles operating within a plurality of predetermined regions for which users of a plurality of mobile devices are responsible, analyzing, at the vehicles, the recorded data for violation of one of a plurality of predetermined safety parameters by the vehicles, and transmitting, to a central server, data associated with a safety parameter violation by a vehicle in violation of one of the predetermined safety parameters. A safety event alert is generated at the central server for the vehicle in violation in response to receiving the transmitted data, and the safety event alert is communicated from the central office to a mobile device authorized by the central office to receive the safety event alert for the predetermined region within which the violation occurred.

18 Claims, 13 Drawing Sheets

SAFETY EVENT ALERT SYSTEM AND METHOD

SUMMARY

Embodiments described in this disclosure are generally directed to systems and methods for monitoring and assessing driver behavior and providing timely information on unsafe behavior to an individual(s) responsible for the vehicle and/or driver. A method, according to various embodiments, comprises recording data at a plurality of in-service vehicles operating within a plurality of predetermined regions for which users of a plurality of mobile devices are responsible. The method also involves analyzing, at the vehicles, the recorded data for violation of one of a plurality of predetermined safety parameters by the vehicles, and transmitting, to a central server, data associated with a safety parameter violation by a vehicle in violation of one of the predetermined safety parameters. The method further involves generating a safety event alert at the central server for the vehicle in violation in response to receiving the transmitted data, and communicating the safety event alert from the central office to a mobile device authorized by the central office to receive the safety event alert for the predetermined region within which the violation occurred.

According to other embodiments, a system includes an onboard computing device configured for use at a vehicle operable within a plurality of predetermined regions for which users of a plurality of mobile devices are responsible. The onboard computing device comprises a wireless transceiver and a processor. The processor is configured to receive vehicle data from a vehicle computer system, analyze the received vehicle data for violation of one of a plurality of predetermined safety parameters by the vehicle, and transmit data associated with a safety parameter violation by the vehicle via the wireless transceiver. The system also comprises a central server configured to generate a safety event alert in response to receiving the data transmitted by the vehicle, and communicate the safety event alert to one or more mobile devices authorized by the central office to receive the safety event alert for the predetermined region within which the violation occurred.

In accordance with some embodiments, a system includes a plurality of onboard computing devices configured for use at a plurality of vehicles operable within a plurality of predetermined regions for which users of a plurality of mobile devices are responsible. Each of the onboard computing devices comprises a wireless transceiver and a processor. Each processor is configured to receive vehicle data from a vehicle computer system, analyze the received vehicle data for violation of one of a plurality of predetermined safety parameters by the vehicle, and transmit data associated with a safety parameter violation by the vehicle via the wireless transceiver. The system further comprises a central server configured to communicate with each of the onboard computing devices and receive data associated with the safety parameter violation transmitted by the onboard computing devices. The central server is further configured to generate a safety event alert associated with each violating vehicle in response to the received data, determine which of the mobile devices are authorized to receive the safety event alerts based on the predetermined regions within which the violations occurred, and communicate the safety event alerts to the one or more authorized mobile devices.

These and other features can be understood in view of the following detailed discussion and the accompanying drawings.

DETAILED DESCRIPTION

Embodiments of the disclosure are generally directed to a system and method of assessing driver behavior while operating a vehicle and providing timely information on unsafe behavior to an individual(s) responsible for the vehicle and/or driver. Embodiments of the disclosure are directed to a system and method of detecting unsafe driving of one or more vehicles operating within a predetermined region and alerting an individual(s) responsible for safety within the predetermined region when occurrence of unsafe driving is detected. Various embodiments are directed to a system and method of generating a safety event alert in response to detecting unsafe driving occurring within a predetermined region for which an individual is responsible, and transmitting the safety event alert to a mobile device used by the responsible individual. Timely notification of safety event alerts to individuals responsible for vehicle safety within predetermined regions allows individuals receiving the alerts to take immediate action shortly after the occurrence of an unsafe driving event, such as messaging a driver of the vehicle, requesting and obtaining detailed information about the driver and/or vehicle, and effecting communication of driver/vehicle data to remote electronic devices accessed by other interested individuals.

Figure 1:
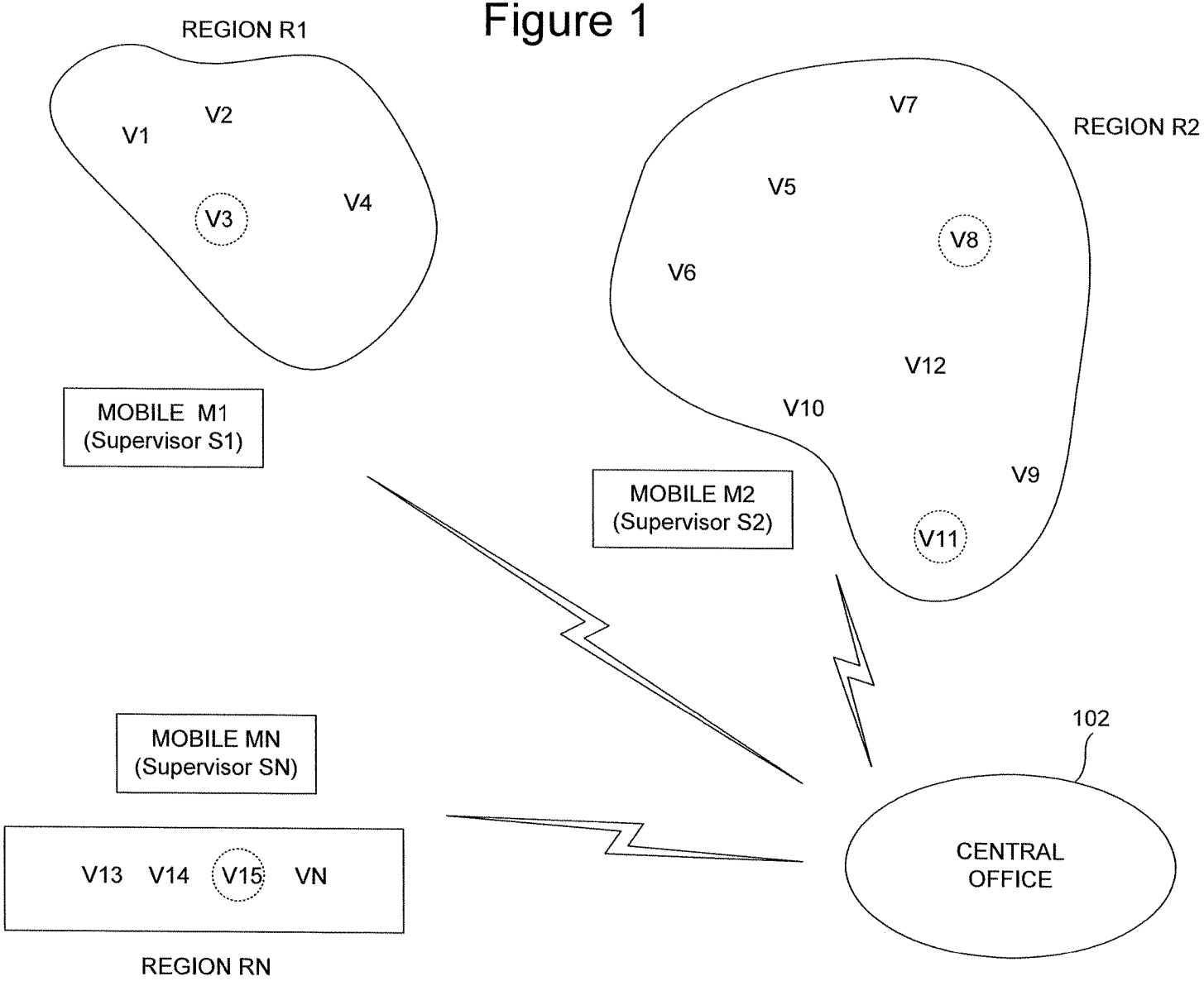
FIG. 1 shows an illustrative environment in which a safety event alert system and method can be implemented in accordance with embodiments of the disclosure.

FIG. 1 illustrates a multiplicity of in-service vehicles (V1-VN, where N is any positive integer) that are operating within a multiplicity of predetermined geographical regions (Regions R1-RN, where N is any positive integer). In the illustrative scenario shown in FIG. 1, the in-service vehicles V1-VN are free to move within and between the various predetermined regions R1-RN. Each of the regions R1-RN is associated with at least one supervisor (S1-SN, where N is any positive integer) or other individual who is responsible for vehicle safety within a particular region. Each supervisor, such as Supervisor S2, has access to a specific mobile device, such as Mobile S2. Each of the vehicles V1-VN (which may each have access to one or more specified devices), and mobile devices S1-SN are configured to communicate with a central office 102 via one or more networks.

Because specific supervisors are responsible for particular regions, each supervisor has an interest in vehicle safety and driving behavior within his or her region of responsibility. In some cases, the supervisors may be conducting business or traveling outside of their designated regions, yet remain responsible for vehicle safety within their designated regions. In other cases, a region under the responsibility of the particular supervisor may be relatively large, making it impractical for supervisor to remain abreast of all vehicle activity within his or her region of responsibility. Embodiments of the present disclosure provide timely (e.g., substantially in real-time) notification to a mobile device accessible by a supervisor of a specific region of a safety violation occurring within the specific region for which the supervisor is responsible.

Each of the vehicles shown in FIG. 1 is equipped with an onboard computing device configured to communicate with the vehicle's computer system and with a central server via a wireless communication link. While each vehicle is operating within (and optionally between) predetermined regions R1-RN, vehicle data is analyzed by the onboard computing device for possible violation of any of a multiplicity of predetermined safety parameters. Upon detecting violation of a predetermined safety parameter, the onboard computing device of the vehicle in violation transmits data concerning the violation to the central office 102. At the central office 102, a safety event alert is generated and communicated to the mobile device of the supervisor who is responsible for the region within which the violation occurred.

In FIG. 1, vehicle V3 of region R1, vehicles V8 and V11 of region R2, and vehicle V15 of region RN are encircled to indicate that these vehicles are in violation of one or more predetermined safety parameters while operating in one of Regions 1-N. In this illustrative scenario, the onboard computer system of each vehicle V3, V8, V11, and V15 transmits its vehicle data associated with the safety violation to the central office 102. In response, the central office 102 generates a safety event alert for each safety violation, determines which mobile devices are authorized to receive the safety event alerts, and transmits the safety event alerts to the authorized mobile devices. For example, mobile device M1 associated with supervisor S1 is authorized by the central office 102 to receive safety event alerts for vehicle safety infractions occurring within region R1. Mobile device M2 associated with supervisor S2 is authorized by the central office 102 to receive safety event alerts for vehicle safety infractions occurring within region R2. Similarly, mobile device MN associated with supervisor SN is authorized by the central office 102 to receive safety event alerts for vehicle infractions occurring within region RN.

According to various embodiments, a mobile device, such as mobile device M1, can be authorized by the central office 102 to receive safety event alerts for vehicle infractions occurring only within the region or regions for which supervisor S1 is responsible (i.e., R1 in FIG. 1), but no other region (i.e., R2 or RN in FIG. 1). It is noted that more than one supervisor, and therefore more than one mobile device, may be associated with a given region. It is further noted that a particular supervisor may be responsible for more than one region, and therefore his or her mobile device may be authorized to receive safety event alerts for more than one region.

In some embodiments, a region for which a given supervisor is responsible can constitute a geographical area such as a city, state, or region of the country. A region may be defined by a single geographical area or multiple geographical areas for which a particular supervisor is responsible (i.e., docking bays at a multiplicity of warehouses owned by Company X). In various embodiments, a region for which a given supervisor is responsible can constitute a transportation terminal, such as an airport terminal, a loading terminal, a container terminal, a harbor, or a warehouse (e.g., packing, railway, river/canal), for example. It is noted that one or more supervisors may be responsible for the same region or regions.

Figure 2:
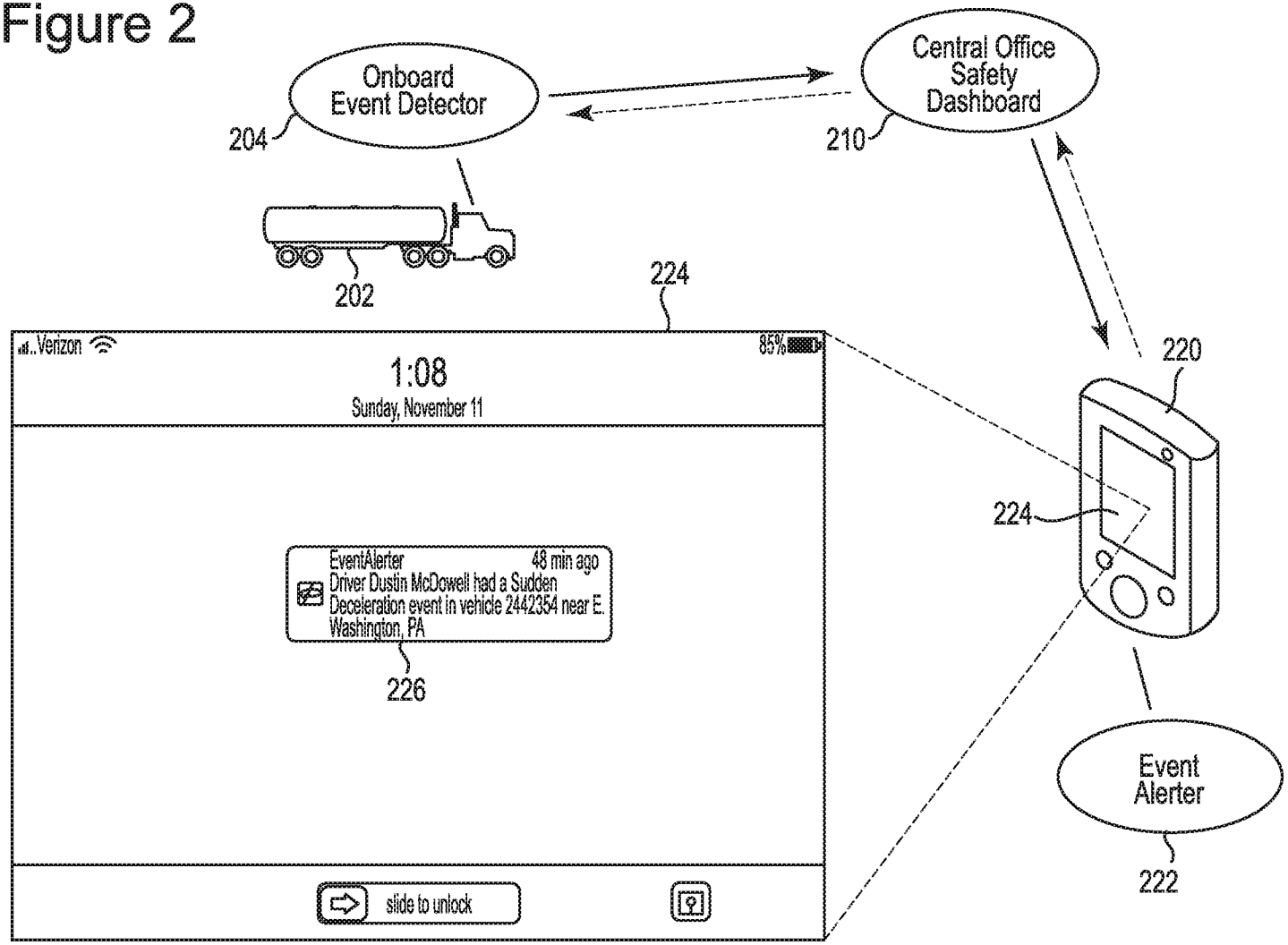
FIG. 2 illustrates a system for generating safety event alerts in response to violation of a vehicle safety parameter by one or more vehicles in accordance with various embodiments.

Turning now to FIG. 2, there is illustrated a system for generating safety event alerts in response to violation of a vehicle safety parameter by one or more vehicles in accordance with various embodiments. In the illustrative embodiment shown in FIG. 2, a vehicle 202 includes an onboard computer system configured to communicate with the vehicle's computer system and a central office 210. The onboard computer system of the vehicle 202 includes an onboard event detector 204, which is configured to analyze data acquired at the vehicle 202 for possible violation of any of a multiplicity of predetermined safety parameters. A non-exhaustive, non-limiting list of predetermined safety parameters includes sudden acceleration, sudden deceleration, rollover stability, lane departure, and following distance, among others. In response to detecting violation of a predetermined safety parameter, the onboard event detector 204 transmits selected vehicle data to the central office 210, which implements a safety dashboard in accordance with various embodiments. The safety dashboard implemented at the central office 210 generates a safety event alert 226 in response to the vehicle data received from the onboard event detector 204. The central office 210 determines which mobile device 220 is authorized to receive the safety event alert 226.

FIG. 2 shows a representation of a display 224 of a supervisor's mobile device 220 that is capable of running an Event Alerter application. The display 224 shows a representative safety event alert 226 according to various embodiments. The safety event alert 226 shown in FIG. 2 identifies the name of the driver (e.g., Dustin McDowell), the safety parameter violation (e.g., Sudden Deceleration), the vehicle number (e.g., 2442354), and the location of the violation (e.g., near E. Washington, Pa.). The mobile device 220 is capable of executing an Event Alerter application which is configured to authenticate the mobile device 220 to the central office 210 and effect communication between the central office 210 and the mobile device 220. The Event Alerter application can be downloaded from a consumer application store on the Internet according to some embodiments.

According to various embodiments, the central office 210 determines the location of the vehicle 202 where the safety parameter violation occurred based on location data received as part of the vehicle data from the onboard event detector 204. The central office 210 determines the mobile device or devices 220 that are associated with a supervisor or supervisors responsible for the region where the safety infraction occurred. In this illustrative embodiment, only the supervisor or supervisors who are identified at the central office 210 as being responsible for safety infractions within the region where the driving infraction occurred are authorized to receive to the safety event alert 226. The safety event alert 226 is then transmitted by the central office 210 to the authorized mobile device or devices 220.

Figure 3:
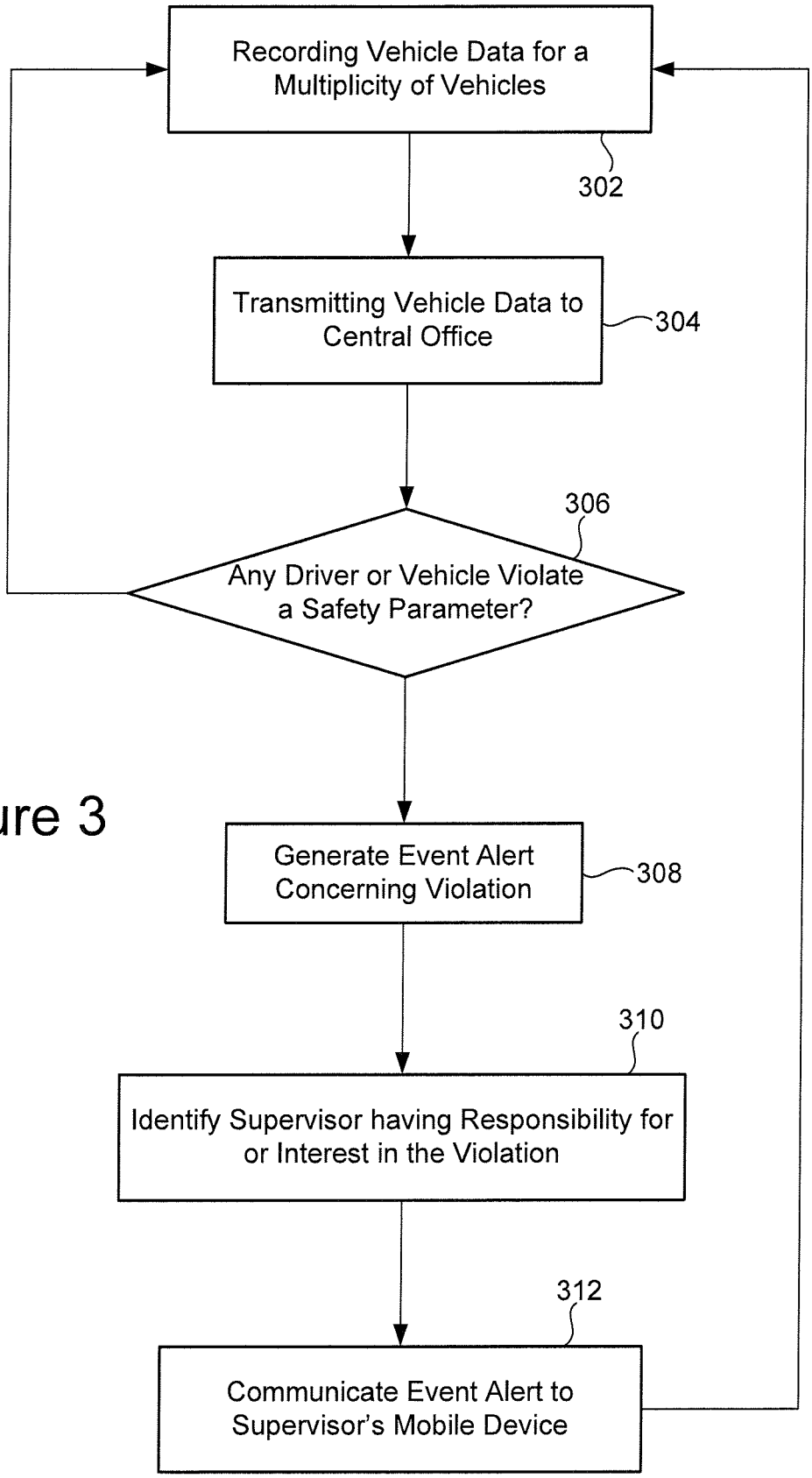
FIG. 3 illustrates various processes for generating a safety event alert in response to detecting a vehicle safety violation in accordance with various embodiments.

Turning now to FIG. 3, there is illustrated various processes for generating a safety event alert in response to detecting a vehicle safety violation in accordance with various embodiments. The processes shown in FIG. 3 involve recording 302 vehicle data for a multiplicity of vehicles. The vehicle data typically includes data acquired from a vehicle's computer system, but may also include driver data acquired from one or more sensors (e.g., lane departure sensor, following distance sensor) installed at the vehicle. While operating the vehicle, vehicle data is transmitted 304 to a central office. In various embodiments, vehicle data is analyzed at the vehicle for possible violation of one or more predetermined safety parameters. Upon detecting violation of a predetermined safety parameter, vehicle data associated with the violation is transmitted from the vehicle to the central office. In other embodiments, the central office analyzes vehicle data for possible violation of one or more predetermined safety parameters. In yet other embodiments, both the vehicle and the central office can be configured to analyze vehicle data for possible safety parameter violations, at least for purposes of performing a double check (validation) of the violation analysis.

A check 306 is made to determine if any driver or vehicle violates the safety parameter. If not, vehicle data continues to be recorded, analyze, and communicated to the central office. If so, an event alert is generated 308 concerning the violation. In various embodiments, the event alert is generated at the central office, while in some embodiments, the event alert can be generated by a particular vehicle in violation of the specific safety parameter. The process shown in FIG. 3 further include identifying 310 the supervisor or supervisors having responsibility for or interest in the safety violation. The identification process 310 identifies the mobile device or devices accessible by the supervisor or supervisors authorized to receive the event alert. The event alert is then communicated 312 to the mobile device or devices of the supervisor or supervisor.

Figure 4:
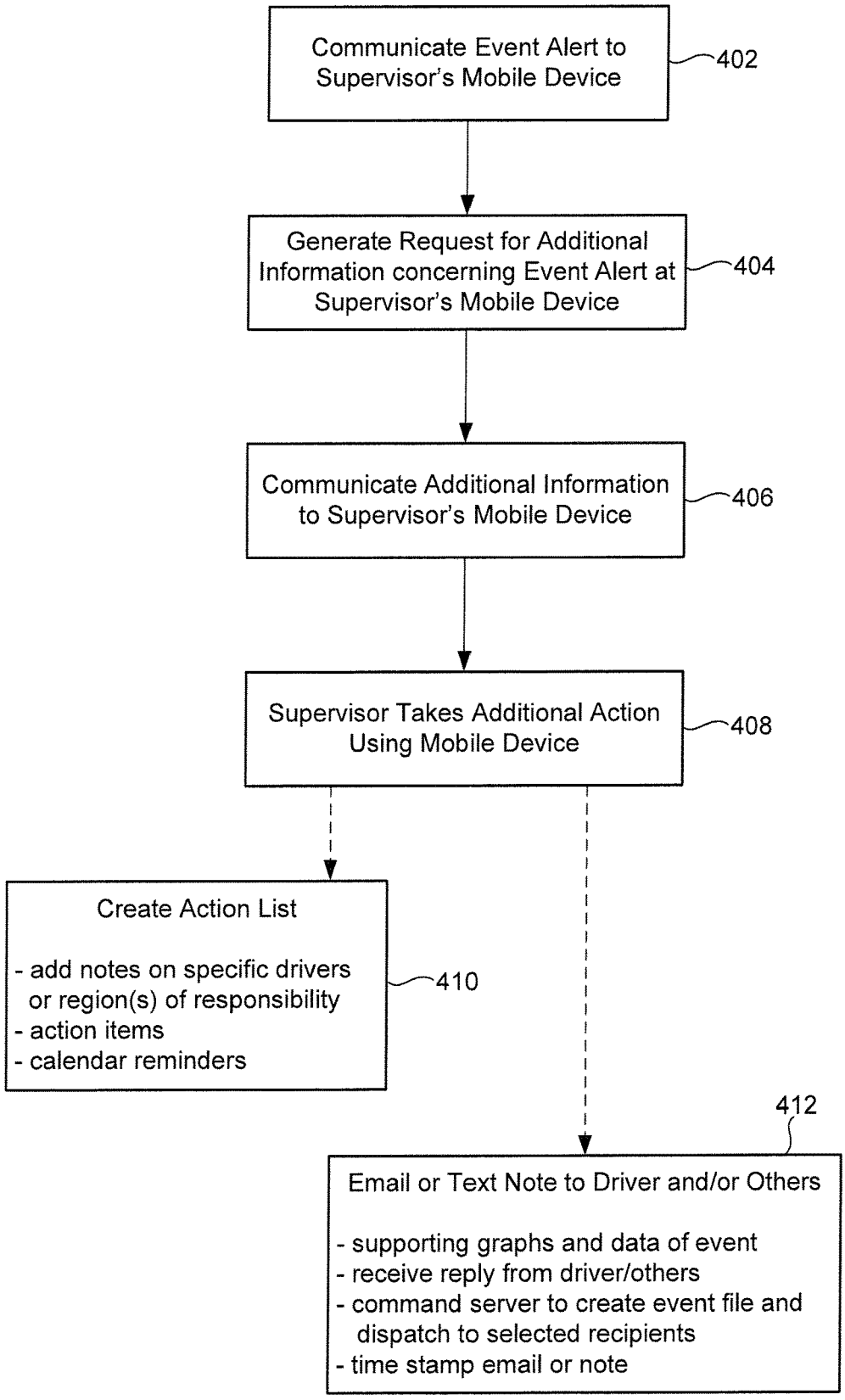
FIG. 4 illustrates various processes for generating a safety event alert and response to detecting vehicle safety violations in accordance with various embodiments.

FIG. 4 illustrates various processes for generating a safety event alert and response to detecting vehicle safety violations in accordance with various embodiments. The process shown in FIG. 4 involve communicating 402 an event alert to a supervisor's mobile device, such as in a manner described previously with reference to FIG. 3. According to various embodiments, a supervisor may generate 404 a request for additional information concerning the event alert using the supervisor's mobile device. This request is transmitted to the central office which, in response, communicates 460 additional information to the supervisor's mobile device. In some embodiments, the supervisor may take additional action 408 using the mobile device. For example, the supervisor may create 410 an action list such as adding notes about the event alert, which may include comments about the driver or region involved; create action items; and/or generate calendar reminders to facilitate follow-up activities.

By way of further example, a supervisor may create 412 an email or text note that can be delivered to the driver via the central server or via a cellular or satellite link. An email or text note can also be delivered to other parties that may have an interest in the event alert. The email or text notice is typically time stamped in order to preserve the day and time of a communication's origination. According to some embodiments, the supervisor may request the central office to communicate supporting graphs and data concerning the event that resulted in the event alert, and this data may be communicated to persons having an interest in the event. Other functions that can be taken by supervisor in response to an event alert include receiving a reply from the driver and from others in response to a previously dispatched email or text note, and/or command the server at the central office to create an event file and dispatch the event file to selected recipients. In some embodiments, the supervisor may request the central office to create an event file for reception by the supervisor's mobile device. The supervisor may forward the received event file from his or her mobile device to other recipients (mobile or stationary devices).

Figure 5:
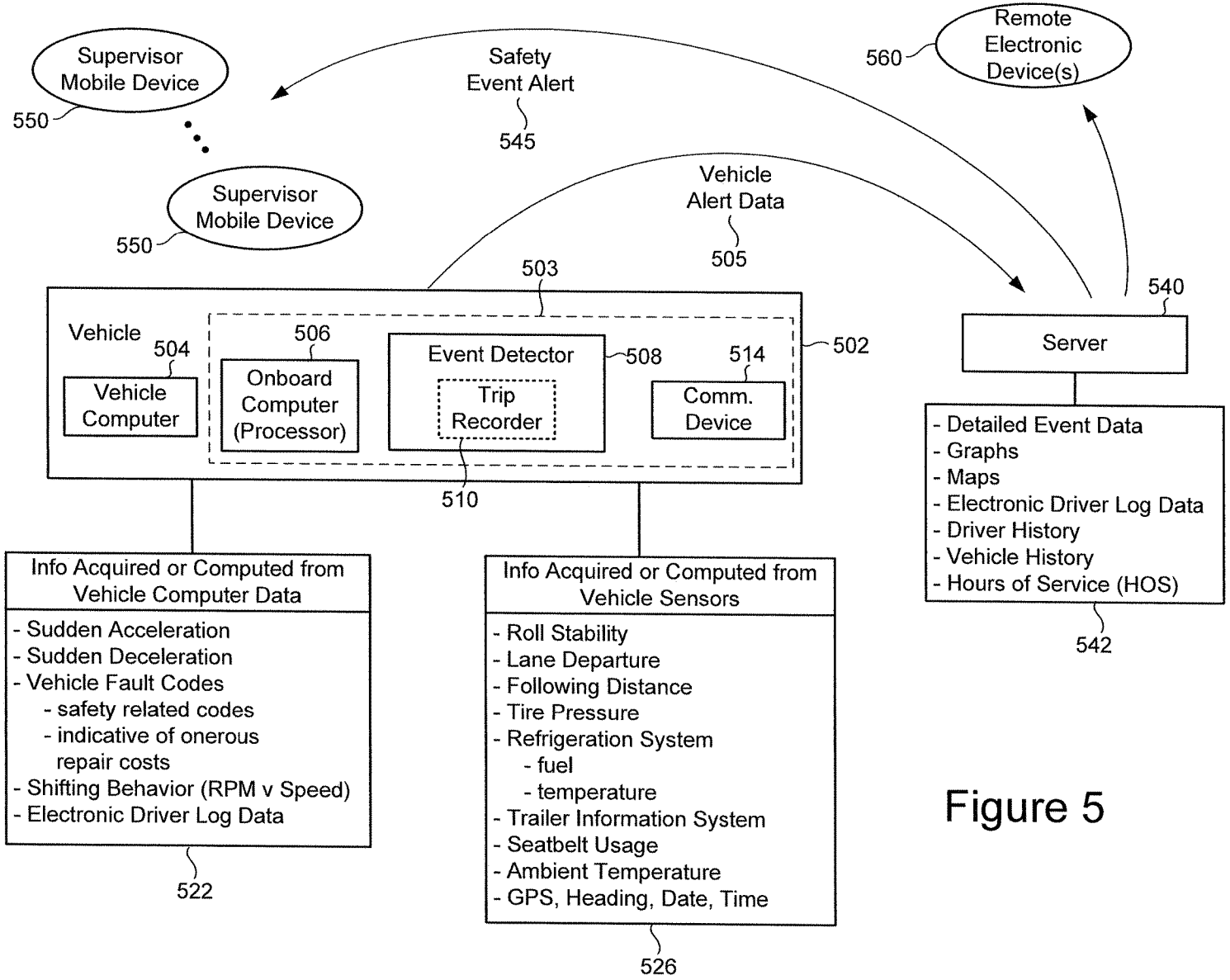
FIG. 5 is a system block diagram showing various components of an event alert system for reporting on vehicle safety in accordance with various embodiments.

FIG. 5 is a system block diagram showing various components of an event alert system for reporting on vehicle safety in accordance with various embodiments. The representative system shown in FIG. 5 includes a vehicle 502, a server 540 at a central office, and one or more mobile devices 550 accessible by one or more supervisors, each of whom is responsible for vehicle safety within one or more predetermined regions with which the vehicle 502 may operate. The vehicle 502 includes a vehicle computer 504 which is typically installed and programmed by the manufacturer of the vehicle 502. The vehicle 502 also includes an onboard computer system 503, which is typically installed in the vehicle 502 after manufacturing. The onboard computer system 503 includes a number of components, including an onboard computer or processor 506, an event detector 508, and a communication device 514. The communication device 514 includes a wireless transceiver configured to communicate with the server 540 via one or more networks. The onboard computer 506 includes an interface to communicate with the vehicle computer 504, typically over a communication bus of the vehicle computer 504.

According to various embodiments, the event detector 508 includes a trip recorder 510. The trip recorder 510 may be implemented as a software program executable by the onboard computer 506. In some embodiments, the trip recorder 510 collects various types of vehicle data from the vehicle computer 504, as well as other data. For example, the trip recorder 510 can be implemented to collect GPS and heading data, vehicle electronic control module (ECM) data (e.g., ECM emissions, fuel, air, speed, fluid pressures, and temperatures), date/time, engine RPM, RPM versus speed data for evaluating shifting behavior, electronic driver log data, vehicle fault codes, tire pressure data and tire pressure exception data, among other data. In some embodiments, data acquired by the trip recorder 510 is collected in a bolus every n seconds (e.g., every 2 seconds in 2 second breadcrumbs). The event detector 508 analyzes the data acquired by the trip recorder 510 for possible violation of one or more predetermined safety parameter violations. In some embodiments, data acquired by the trip recorder 510 is communicated wirelessly to the server 540 in 2 second breadcrumbs and on a continuous basis, assuming presence of a reliable communication link. In cases where a reliable connection link is not established, the trip recorder data is buffered at the vehicle and transmitted to the server 540 when communication is reestablished with the server 540. The server 540 may be configured to operate on the trip recorder data for a variety of purposes.

In accordance with some embodiments, the onboard computer 506 is configured to acquire or compute a set of data 522 based on information made available by the vehicle computer 504. This set 522 of vehicle data acquired or computed by the onboard computer 506 includes: sudden acceleration, sudden deceleration, vehicle fault codes (safety related codes, codes indicative of onerous repair costs), shifting behavior data (RPM versus speed), and electronic driver log data. As was previously discussed, the onboard computer 506 may be configured to acquire information from various vehicle sensors. A representative set of vehicle sensor data 526 acquired or computed by the onboard computer 506 based on vehicle sensor information includes: roll stability, lane departure, following distance, tire pressure, refrigeration system (e.g., fuel, temperature), trailer information system, seatbelt usage, ambient temperature, GPS, heading, date/time.

According to various embodiments, the event detector 508 is configured to analyze various vehicle computer information and vehicle sensor information for possible violation of one or more predetermined safety parameter violations. For example, the event detector 508 can be programmed to detect events of sudden acceleration, sudden deceleration, roll instability, lane departure, and following distance violations. Thresholds for each of these representative safety parameters can be established and/or modified by an authorized user of the onboard computer system 503, such as a fleet owner. The event detector 508 analyzes the various vehicle computer data and sensor data to determine if a threshold associated with any of the predetermined established safety parameters has been exceeded. If so, the event detector 508 declares a safety event and, in response, vehicle alert data 505 is transmitted from the onboard computer system 503 to the server 540 via the medications device 514. The vehicle alert data 505 can include a variety of data surrounding the safety event, for example, a predetermined amount of data prior to and after the declared safety event can be collected and transmitted as vehicle alert data 505 to the server 540. In one embodiment, 90 seconds worth of vehicle and/or sensor data is collected (e.g., in 2 second breadcrumbs) prior to a detected safety event, and 30 seconds worth of vehicle and/or sensor data is collected (e.g., in 2 second breadcrumbs) after the detected safety event. It is understood that the collected data includes data produced during the safety event.

The data collected during and surrounding a detected vehicle safety event can be analyzed by the server 540 to produce a myriad of output 542. The server 540 can be configured to generate various output data based on the collected safety event data and other data available in the server 540. The server 540 can, for example, produce detailed event data, various graphs and maps, electronic driver log data, driver history information, vehicle history information, and hours of service (HOS) data. Some or all of this data 545 can be requested by an authorized supervisor or other authorized individual, and transmitted to a mobile device or other electronic device 560 associated with an authorized recipient of the data.

Figure 6:
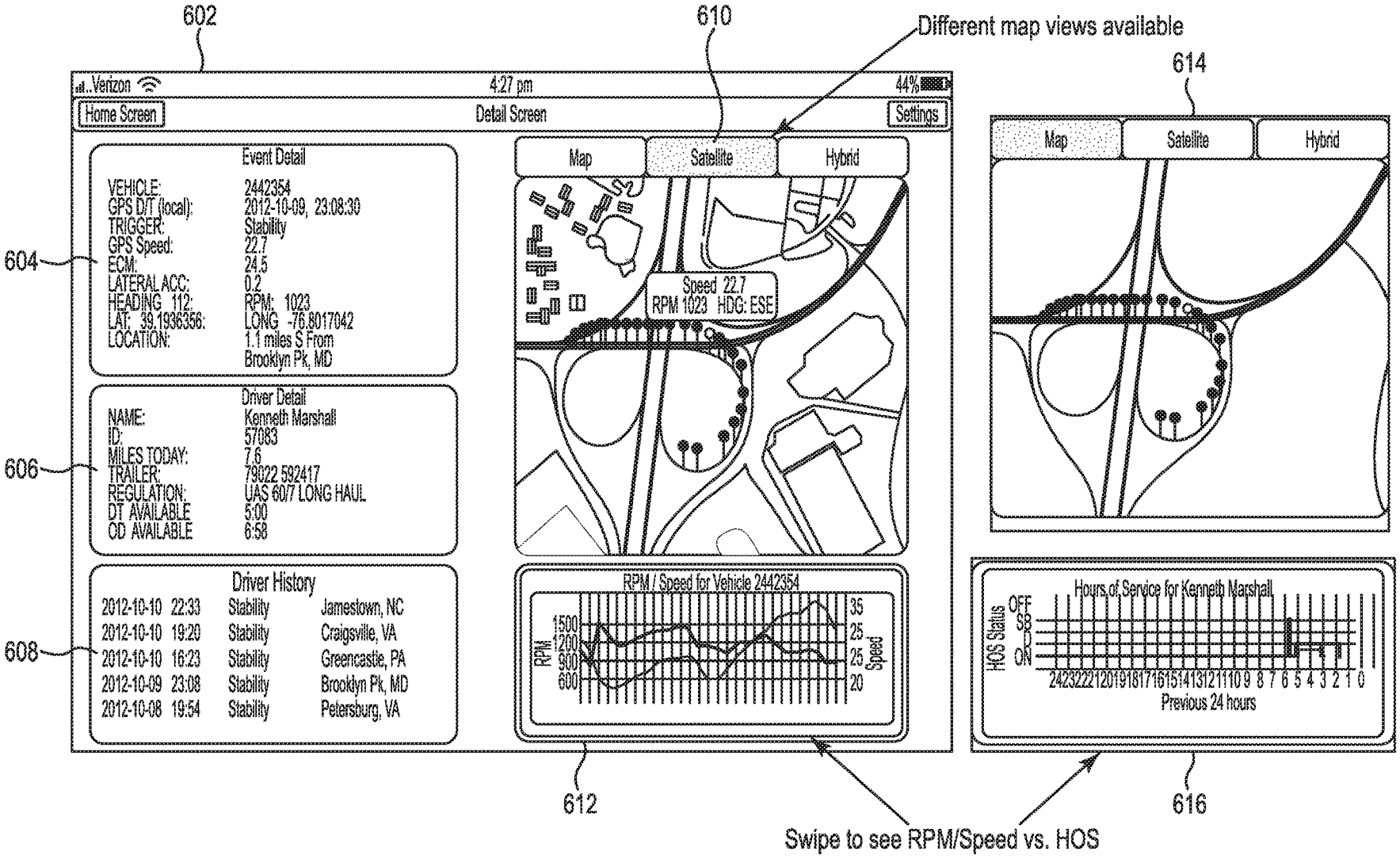
FIG. 6 illustrates various safety event alert information that can be presented on a display of a mobile device associated with a recipient (e.g., supervisor of a particular region where a vehicle safety violation occurred) authorized by a central office to receive the safety event alert information in accordance with various embodiments.

FIG. 6 illustrates various safety event alert information that can be presented on a display of a mobile device associated with a recipient (e.g., supervisor of a particular region where a vehicle safety violation occurred) authorized by a central office to receive the safety event alert information in accordance with various embodiments. In the embodiment shown in FIG. 6, a display 602 of a mobile device shows various panels of safety event alert information received from a central office in response to a detected vehicle safety parameter violation. In this illustrative embodiment, it is assumed that the mobile device on which the safety event alert information is presented is associated with a supervisor or other individual who is authorized by the central server to receive the information. The authorized individual may, for example, be responsible for vehicle safety within a predefined region of the east coast of the United States, such that the information presented on the display 602 is limited to vehicle safety data associated with this predefined region. In some embodiments, a supervisor may be authorized to view information about a particular vehicle or driver that includes data acquired beyond the supervisor's predefined region. For example, a supervisor may wish to view the safety event history of a particular driver or a specific vehicle. The history data for the driver or vehicle may include information acquired from safety violations occurring outside the region or regions for which the supervisor is responsible. Notwithstanding, the supervisor may be authorized by the central office to receive limited information (e.g., driver history, vehicle history) developed from data acquired from safety events occurring within regions other than that/those for which the supervisor is responsible.

In accordance with one non-limiting illustrative example, and with continued reference to FIG. 6, assume that the onboard event detector of a particular vehicle operating within a predetermined region of the east coast of the United States detects an Stability Event (e.g., roll instability). In response to the detected safety event, vehicle alert data collected from the vehicle is transmitted to the central office. The central office processes the received vehicle alert data and generates a safety event alert, which is transmitted to the mobile device of a supervisor who is responsible for this predetermined region. The safety event alert may be similar to that shown as Event Alert 226 in FIG. 2. This initial safety event notification to the supervisor's mobile device is intended to alert the supervisor to the occurrence of a vehicle safety situation and provide summary information regarding same. The supervisor may, if desired, request additional information regarding the safety incident, such as by touching/clicking on the Event Alert 226 button shown in FIG. 2. It is understood that the Event Alerter application running on the supervisor's mobile device can provide other means for the supervisor to request additional safety event alert data from the central office.

In response to the supervisor's request for additional information about the safety alert event, various types of data can be transmitted from the central office to the supervisor's mobile device for viewing. FIG. 6 shows different panels of safety event-related information viewable by the supervisor on the display 602 of the supervisor's mobile device. Depending on the size of the mobile device (or stationary device if used), the different panels of information shown in FIG. 6 can be presented individually or in combination on the display 602. According to one illustrative scenario, clicking on an Event Alert message (e.g., see Event Alert 226 in FIG. 2) serves as a request from the supervisor to the central server for Event Detail information. In response, a panel 604 of Event Detail information is transmitted from the central office to the supervisor's mobile device. The Event Detail data shown in panel 604 on the display 602 includes the following information: vehicle ID, date and time, safety violation (Stability), ECM, lateral acceleration, heading, engine RPM, latitude, longitude, and location.

The supervisor may request detailed data on the driver of the violating vehicle. Driver Detail data, shown in panel 606, is transmitted by the central office to the supervisor's mobile device, and can include: name, ID, total miles traveled for the day, trailer ID, applicable regulations, HOS information, such as allowed driving time (DT) available and allowed on-duty-not driving time (OD) available. The supervisor may request historical data on the driver, which can be transmitted by the central office and presented on the display 602. Representative Driver History information is shown in panel 608, and can include: date and time of past events, safety violations, and locations of past events.

Figure 7B:
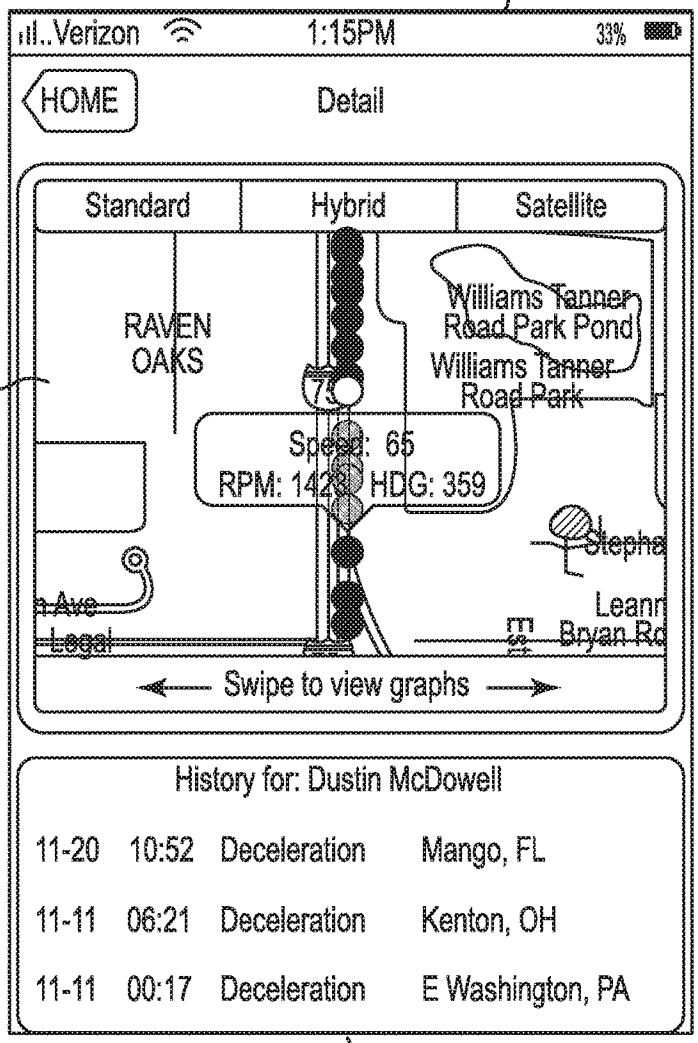
FIGS. 7A and 7B show Event Detail information for a representative safety event involving a specific driver in accordance with various embodiments.
Figure 7A:
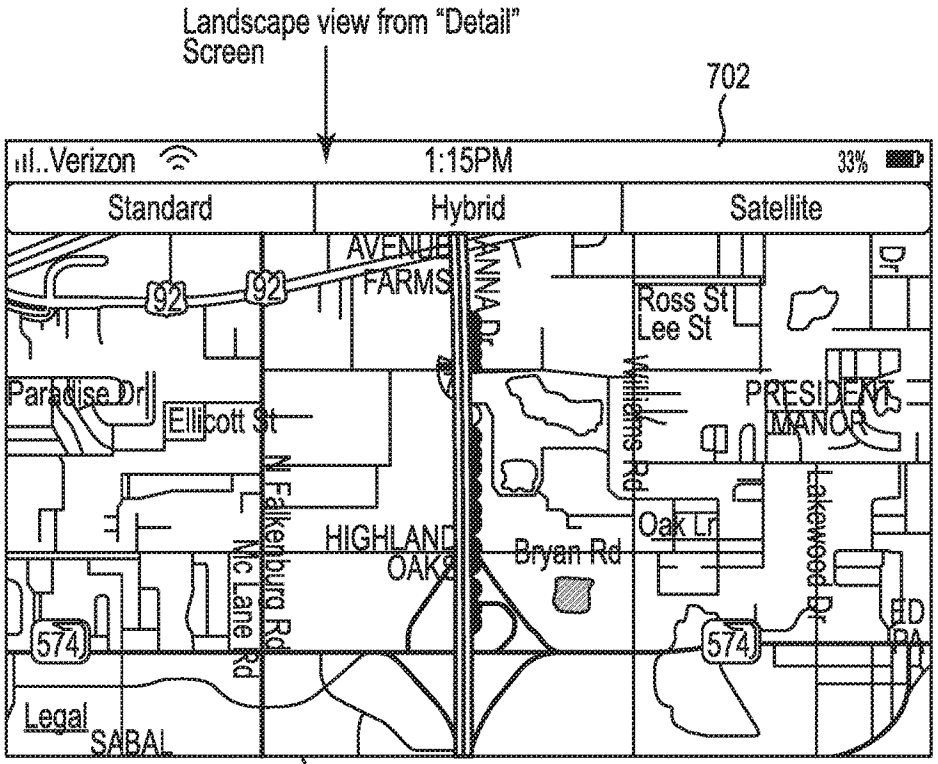

Various maps and other data associated with a safety event alert can be requested by the supervisor via his or her mobile device. Panels 610 and 614 in FIG. 6 are satellite and map views of the location where the safety event (stability) occurred. The supervisor can perform a swipe or other gesture to request other data, such as a graph 612 of RPM vs. Speed for the offending vehicle and hours of service (HOS) 616 for the offending driver. FIGS. 7A and 7B show Event Detail information for a representative safety event involving a specific driver (Dustin McDowell). In FIG. 7B, the Event Detail information is presented in a portrait orientation, with a map 706 showing the safety event location in the upper portion of the display 702 and Driver History information 708 presented in the lower portion of the display 702. Each of the red dots represents a set of detailed vehicle/driver data (e.g., 2 second breadcrumbs of data) that was acquired by the onboard event detector of the vehicle before, during, and after the safety event. Summary data and detailed data for each of the red dots can be displayed by clicking on one of the red dots (for summary information) and/or double clicking on a red dot (for detailed information). According to some embodiments, manually turning the mobile device's display 702 from a portrait orientation to a landscape orientation causes a change in the information presented on the display 702. In the illustrative embodiment shown in FIG. 7A, an expanded view of the map 706 is presented in landscape. It is understood that changing the orientation of the display 702 can cause different types of information to be presented on the display 702.

Figure 8:
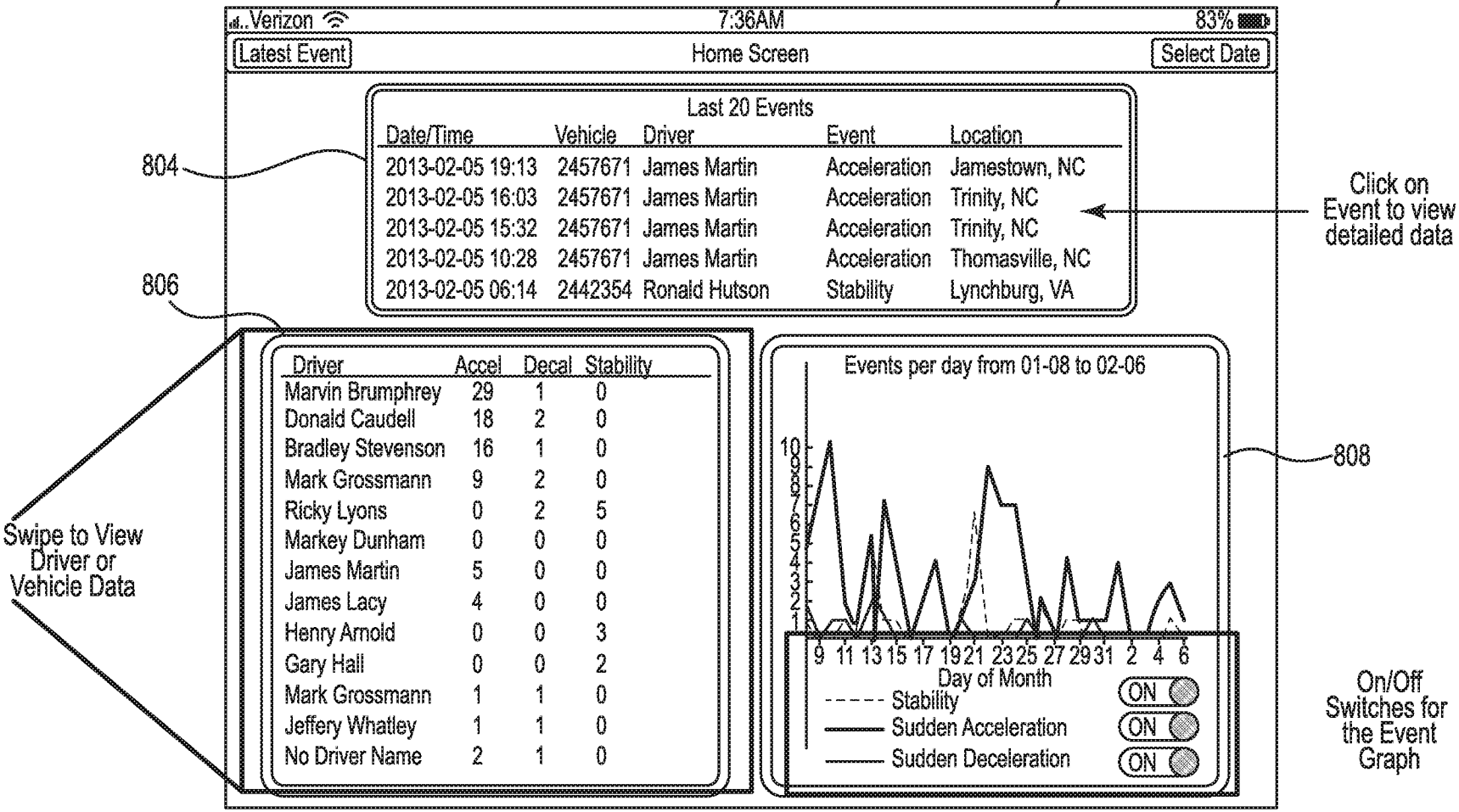
FIG. 8 shows three different panels of safety event alert information that can be presented on a display of a mobile device that is running an Event Alerter application in accordance with various embodiments.

In FIG. 8, three different panels 804, 806, 808 of safety event alert information are shown for illustrative purposes. In typical operation, each of these panels 804, 806, 808 is separately displayed on the display 802 of the mobile device in response to different actions taken by the supervisor when interacting with the mobile device. For example, by clicking on an Event Alert message initially presented on the display 602 (e.g., as is shown in FIG. 2), and performing another predefined gesture (e.g., a swipe) across the Event Detail panel, a summary 804 of past safety events (e.g., last 20 safety events) occurring within the predetermined region for which the supervisor is responsible can be presented on the display 802. The summary 804 of past safety events can include the following safety event data: date/time of the event, vehicle, driver, safety violation, and location of the event. Additional details about the current event (the most recent event of the summary 804) or any of the displayed past events can be obtained by the supervisor clicking on the event of interest. Performing a predefined gesture, such a left swipe or right swipe, can result in presentation of additional information, such as driver and vehicle data (panel 806) and safety events occurring within a specified time period (panel 808). In panel 806, a histogram of all predetermined safety parameter violations (e.g., Stability, Sudden Acceleration, Sudden Deceleration) is shown, with ON/OFF buttons or switches made available to allow suppression or presentation of data for each of the predetermined safety parameters in graphical form.

Figure 9:
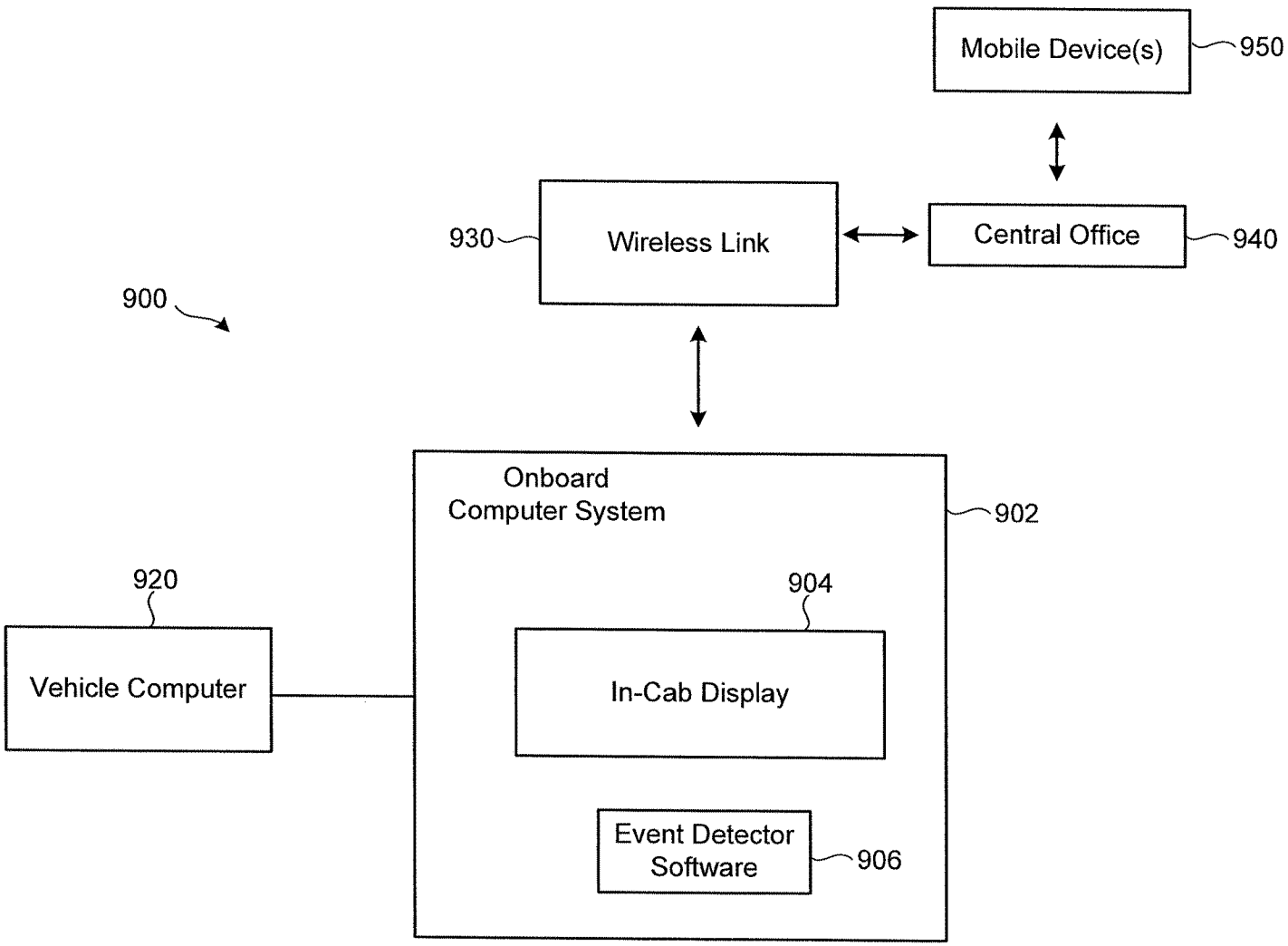
FIG. 9 is a block diagram of a system for generating safety event alerts in response to violation of a vehicle safety parameter by one or more vehicles in accordance with various embodiments.

FIG. 9 is a block diagram of a system 900 for generating safety event alerts in response to violation of a vehicle safety parameter by one or more vehicles in accordance with various embodiments. According to the representative embodiment of FIG. 9, the system 900 includes an onboard computer system 902 which is provided at the vehicle. Among various components, the onboard computer system 902 includes an in-cab display 904, which is mounted in the vehicle cab (e.g., fixedly or as a removable handheld device) and Event Detector software 906 stored in a memory of the onboard computer system 902. The onboard computer system 902 is communicatively coupled to a vehicle computer 920, which is typically the information hub of the vehicle, and also to a central office 940 via one or more communication links, such as a wireless link 930. Connectivity between the onboard computer system 902 and the central office 940 may involve a number of different communication links, including cellular, satellite, and land-based communication links. The central office 940 provides for connectivity between one or more mobile devices 950 (e.g., authorized users, such as region supervisors) and one or more servers of the central office 940.

Figure 10:
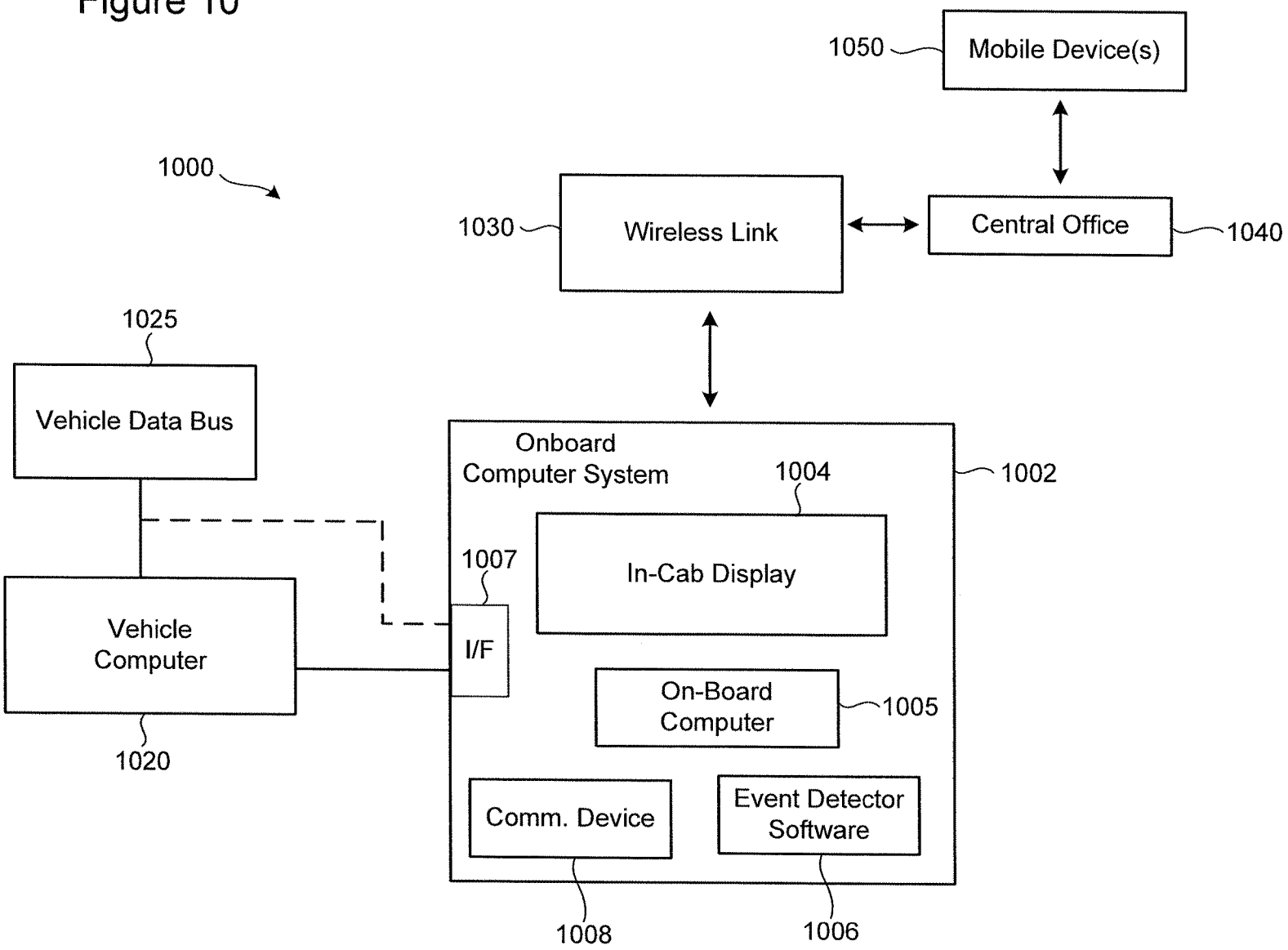
FIG. 10 is a block diagram of the system for generating safety event alerts in response to violation of a vehicle safety parameter by one or more vehicles in accordance with various embodiments.

FIG. 10 is a block diagram of the system 1000 for generating safety event alerts in response to violation of a vehicle safety parameter by one or more vehicles in accordance with various embodiments. In the representative embodiment shown in FIG. 10, the system 1000 includes an onboard computer system 1002 communicatively coupled to a vehicle computer 1020 via an interface 1007 and to a central office 1040 via a wireless link 1030. The central office 1040 is communicatively coupled to one or more mobile devices 1050 and to the onboard computer system 1002 via a cellular link, satellite link and/or a land-based link (e.g., via the Internet). The onboard computer system 1002 includes an in-cab display 1004, an onboard computer 1005, Event Detector software 1006, and a communications device 1008. In some embodiments, information acquired by the onboard computer 1005 when implementing the Event Detector software 1006 is obtained from the vehicle computer 1020 via the interface 1007. In other embodiments, the onboard computer system 1002 is coupled to the vehicle data bus 1025, from which the needed information is acquired for the Event Detector Software 1006. In further embodiments, the onboard computer system 1002 is communicatively coupled to both the vehicle computer 1020 and the vehicle data bus 1025 via interface 1007, obtaining needed information from either or both access paths.

Figure 11:
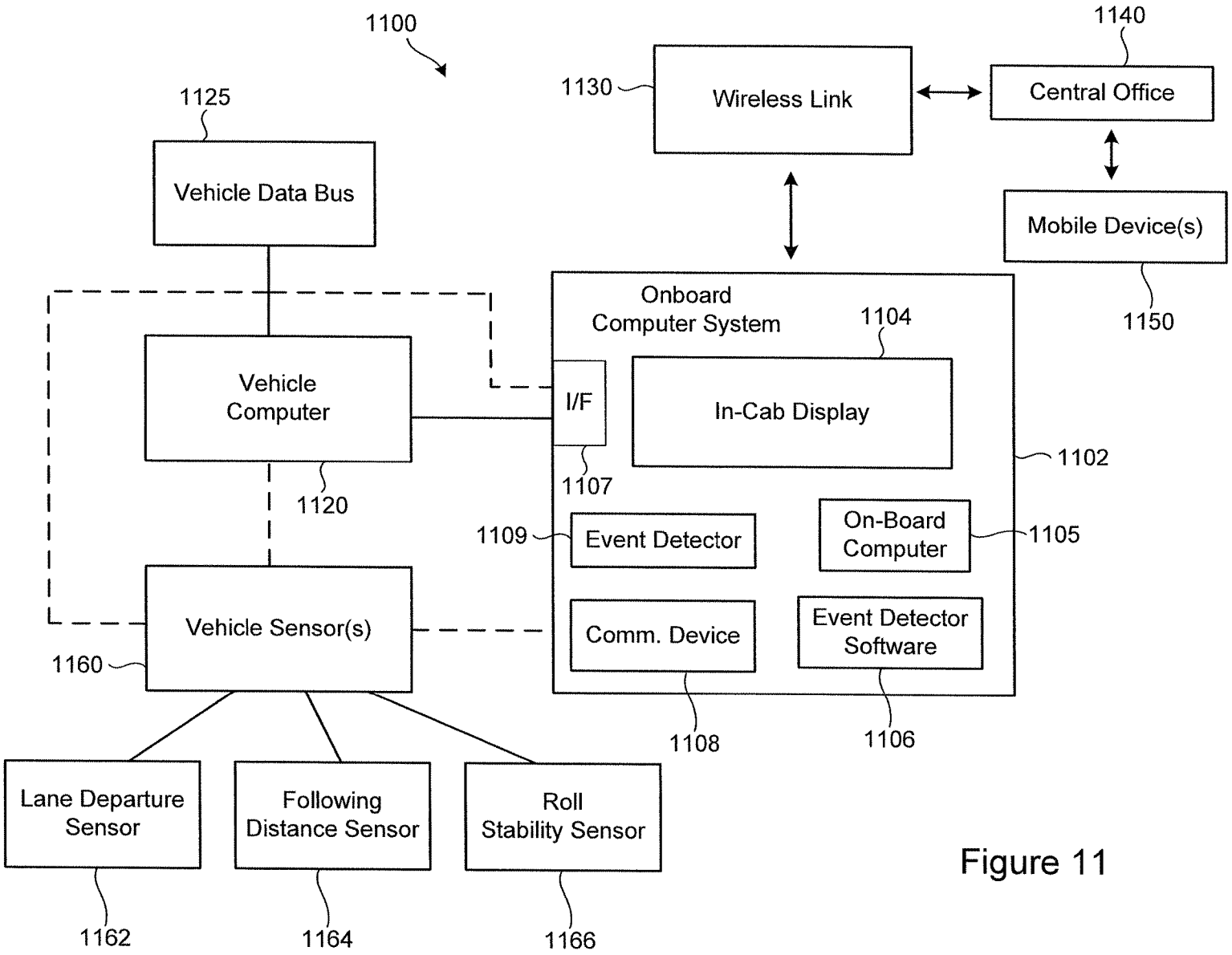
FIG. 11 is a block diagram of a system for generating safety event alerts in response to violation of a vehicle safety parameter by one or more vehicles in accordance with various embodiments.

FIG. 11 is a block diagram of a system 1100 for generating safety event alerts in response to violation of a vehicle safety parameter by one or more vehicles in accordance with various embodiments. In the representative embodiment shown in FIG. 11, the system 1100 includes an onboard computer system 1102 communicatively coupled to a vehicle computer 1120 via an interface 1107 and to a central office 1140 via a wireless link 1130 (and possibly other links). The central office 1140 is communicatively coupled to one or more remote entities 1150 (e.g., mobile devices) and to the onboard computer system 1102 via a cellular link, satellite link and/or a land-based link. The onboard computer system 1102 includes an in-cab display 1104, and onboard computer 1105, Event Detector software 1106, and a communications device 1108. In some embodiments, information acquired by the Event Detector software 1106 is obtained from the vehicle computer 1120 via the interface 1107, while in other embodiments the onboard computer system 1102 is coupled to the vehicle data bus 1125 or to both the vehicle computer 1120 and data bus 1125, from which the needed information is acquired for the Event Detector software 1106.

According to the embodiment shown in FIG. 11, a variety of vehicle sensors 1160 are coupled to one or both of the onboard computer system 1102 and the vehicle computer 1120, such as via the vehicle data bus 1125. A representative, non-exhaustive listing of useful vehicle sensors 1160 include a lane departure sensor 1162 (e.g., a lane departure warning and forward collision warning system), a following distance sensor 1164 (e.g., a collision avoidance system), and a roll stability sensor 1166 (e.g., an electronic stability control system). Representative lane departure warning and forward collision warning systems include Mobileye-5 Series, Takata-SAFETRAK, and Bendix-SAFETYDIRECT. Representative electronic stability control systems include Bendix-(ESP) Electronic Stability Program, and Meritor-(RSC) Roll Stability Control. Representative collision avoidance systems include Bendix-WINGMAN and Merito-ON-GUARD. Each of these sensors 1162, 1164, 1166 or sensor systems is respectively coupled to the vehicle computer 1120 and/or the vehicle data bus 1125. In some embodiments, one or more of the vehicle sensors 1160 can be directly coupled to the onboard computer system 1102.

Figure 12:
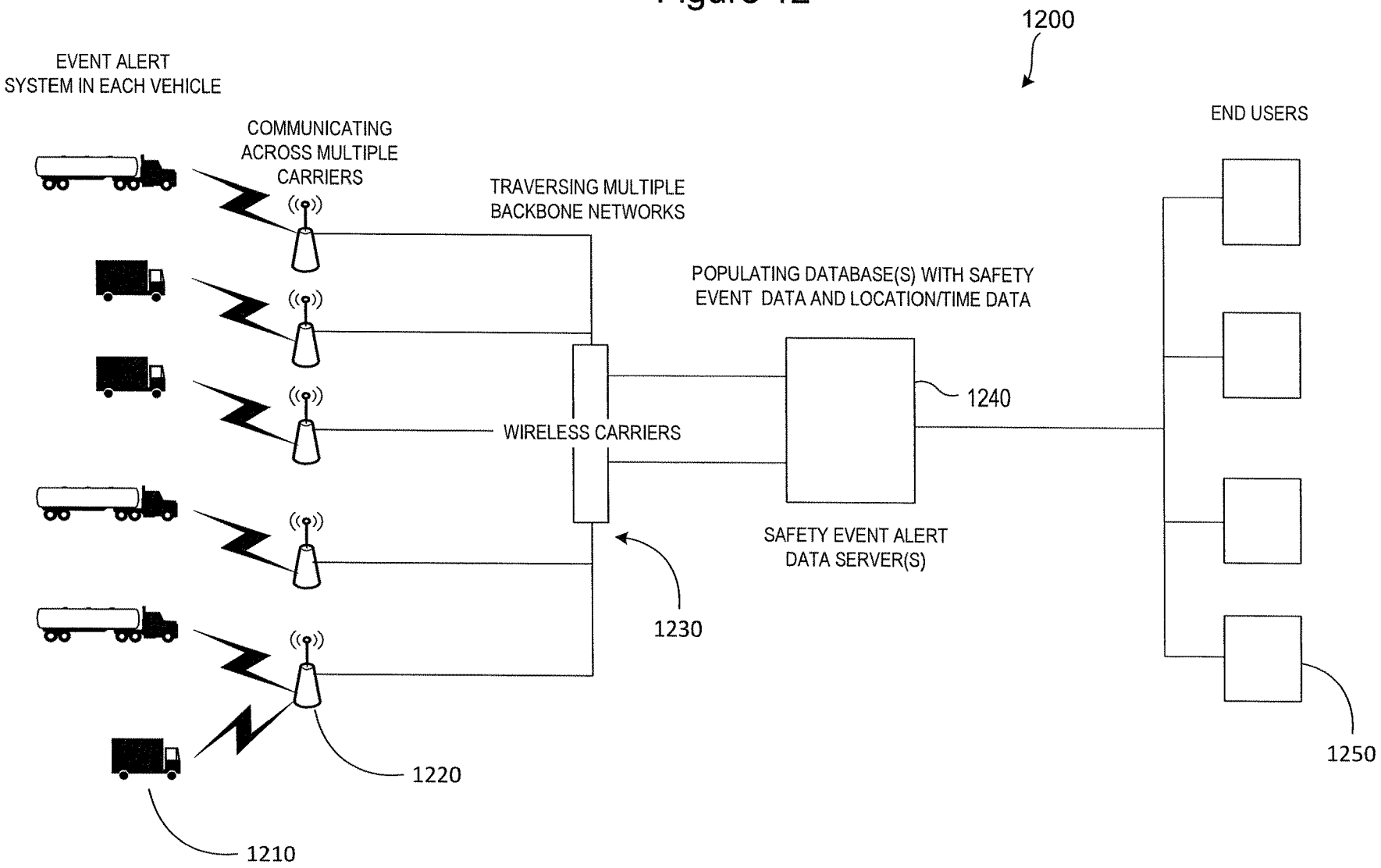
FIG. 12 is a diagrammatic view of a safety event alert system with which various embodiments of the disclosure are particularly applicable.

FIG. 12 is a diagrammatic view of a safety event alert system with which various embodiments of the disclosure are particularly applicable. As illustrated in FIG. 12, a fleet of vehicles may include various types of commercial vehicles 1210 moving through different predetermined regions of a city, state or the country. Each of the vehicles 1210 is configured to communicate wirelessly with a central communication server 1240 (e.g., central office). As used herein, references to a central communication center, central office, data center or other similar reference, do not imply that the entity is necessarily a single facility, although it may be. While the vehicles illustrated in FIG. 12 are depicted as trucks, other vehicles that traverse cellular areas or other wireless communication areas may alternatively or additionally be equipped with communication devices. The vehicles may be, for example, trucks, cars, buses, motorcycles or other vehicles that include the relevant communication capability. Thus, it should be recognized that references to any one or more of the vehicle types is not intended to limit the particular description to the particular type of vehicle unless specifically noted as such.

Communication between each vehicle 1210 and the central office 1240 is predominately effected over-the-air (OTA) using any of a variety of wireless communication technologies. Wireless communication can take the form of cellular communication, such as known CDMA technology, global system for mobile communications (GSM) technology, worldwide interoperability for microwave access (WiMax) technology, or any other suitable technology now known or later developed. Additionally, safety event alert data may be communicated between the individual vehicles 1210 and the central office 1240 using a cellular data channel or via a messaging channel, such as one used to support SMS messaging (i.e. a text message).

According to various embodiments, the vehicles 1210 are equipped with an onboard computing device which includes a cellular transceiver that communicate wirelessly across multiple wireless carriers 1220. Typically, these carriers 1220 may include, for example, providers of CDMA, analog, satellite, etc. The communications traverse multiple backbone networks 1230 before reaching one or more servers 1240 of the central office. Database(s) associated with the servers 1240 are populated with at least safety event data, and may further include geographical location and time data associated with each safety event (e.g., location and time for each safety event that resulted in a safety event being declared). These data are aggregated and processed when received at the servers 1240 and made available for long-term storage. Aggregated data may be converted into, for example, views, reports, graphs, charts maps, and paging setups for consumption by authorized end users 1250, such as a supervisor of a predetermined region within which a safety event occurred.

Figure 13:
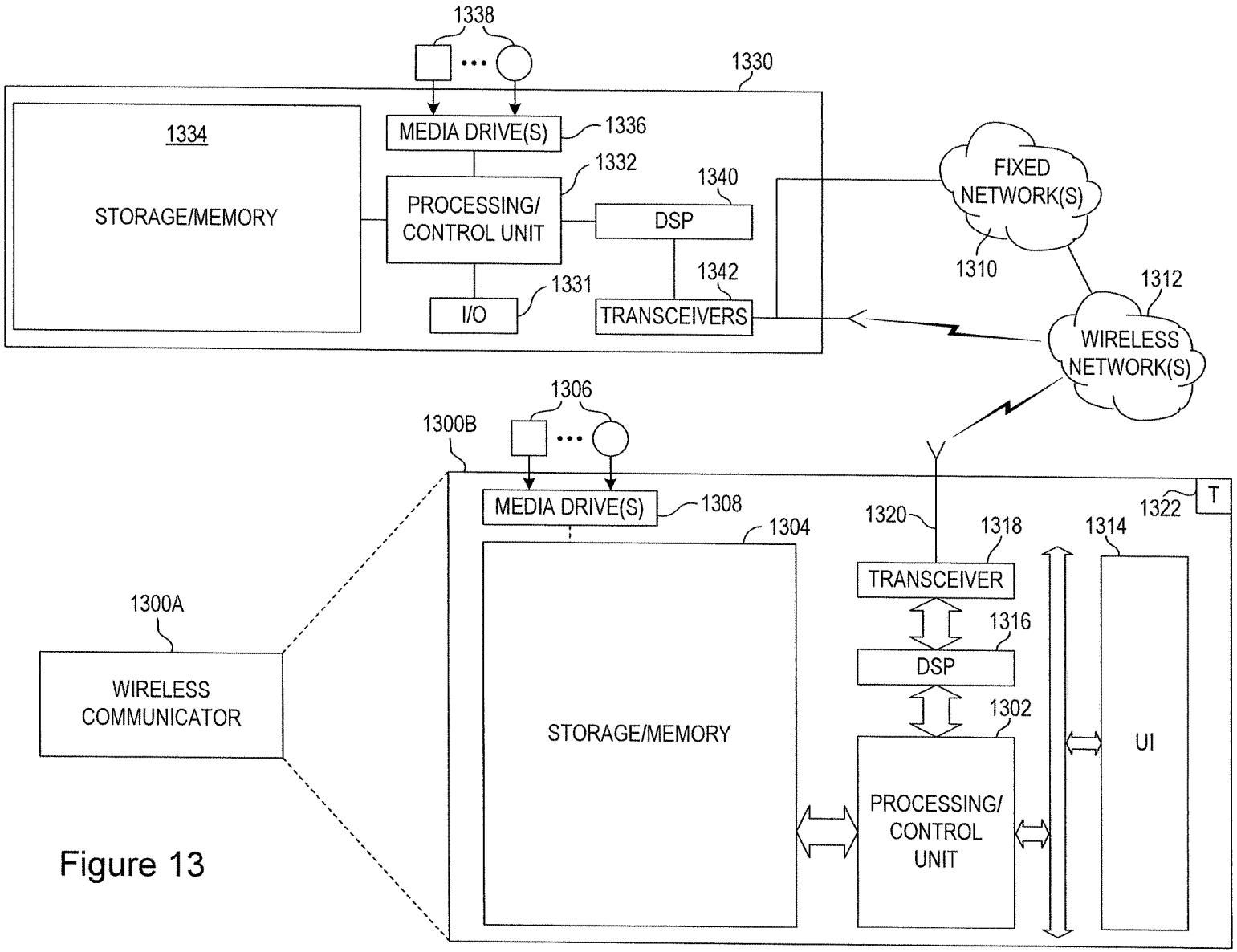
FIG. 13 illustrates representative communication devices that may be used in connection with the safety event alert methodologies described herein to transmit and/or receive information in accordance with various embodiments.

FIG. 13 illustrates representative communication devices that may be used in connection with the safety event alert methodologies described herein to transmit and/or receive information such as safety event and vehicle and/or driver history data. The wireless communicator 1300A represents any communication device capable of performing the vehicle communication functions previously described, such as an onboard computer (OBC). In the illustrated embodiment, the device 1300A represents a device capable of communicating over-the-air (OTA) with wireless networks, such as by way of any one or more of cellular, satellite, etc.

The representative terminal 1300A utilizes computing technology to, among other things, control and manage the wireless communication functions at the vehicle. For example, the representative wireless device 1300B includes a processing/control unit 1302, such as a microprocessor, controller, reduced instruction set computer (RISC), or other central processing module. The processing unit 1302 need not be a single device, and may include one or more processors. For example, the processing unit may include a master processor and one or more associated slave processors coupled to communicate with the master processor.

The processing unit 1302 controls the basic functions of the device 1300B as dictated by programs available in the program storage/memory 1304. The storage/memory 1304 may include an operating system and various program and data modules, such as for collecting the data associated with safety events and presenting/communicating information concerning the safety event. The storage/memory 1304 also stores safety event algorithms (e.g., Event Detector software or program(s)). In one embodiment, the programs are stored in non-volatile storage to retain the programs upon loss of power. The storage 1304 may also include one or more of other types of read-only memory (ROM) and programmable and/or erasable ROM, random access memory (RAM), subscriber interface module (SIM), wireless interface module (WIM), smart card, or other fixed or removable memory device/media. The functional programs may also be provided by way of external media 1306, such as disks, CD-ROM, DVD, or the like, which are read by the appropriate interfaces and/or media drive(s) 1308. The relevant software for carrying out operations in accordance with the present disclosure may also be transmitted to the device 1300B via data signals, such as being downloaded electronically via one or more networks, such as the data network(s) 1310 and/or wireless network(s) 1312.

The processor 1302 may also be coupled to a user interface (UI) 1314 integral with, or connectable to, the device 1300B. The UI 1314 may include, for example, a keypad, function buttons, joystick, scrolling mechanism (e.g., mouse, trackball), touch pad/screen, or other user entry mechanisms (not shown), as well as a display, speaker, tactile feedback, etc. The representative wireless device 1300B of FIG. 13 also includes circuitry for performing wireless transmissions over the wireless network(s) 1312. A DSP 316 may be employed to perform a variety of functions, including analog-to-digital (A/D) conversion, digital-to-analog (D/A) conversion, encryption/decryption, error detection and correction, bit stream translation, filtering, etc. A transceiver 1318 includes at least a transmitter to provide safety event data, and may also include a receiver, thereby transmitting outgoing radio signals and receiving incoming radio signals, generally by way of an antenna 1320. The device 1300B may also include other types of transceivers 1322, such as to enable wired connections to other devices such as diagnostic devices, or to connect to wireless or wired local area networks.

FIG. 13 depicts a representative computing system 1330 situated at a central office and operable on a network, such as an aggregation of communication servers, real-time cache servers, historical servers, etc. The computing system(s) 1330 may be communicated with via the wireless network(s) 1312 and/or fixed network(s) 1310. In one embodiment, the computing system 1330 represents at least the communication servers and associated computing power to collect, aggregate, process and/or present the data associated with safety events. The system 1330 may be a single system or a distributed system. The illustrated computing system 1330 includes a processing arrangement 1332, such as one or more processors, which are coupled to the storage/memory 1334. The processor 1332 carries out a variety of standard computing functions as is known in the art, as dictated by software and/or firmware instructions. The storage/memory 1334 may represent firmware, media storage, memory, etc.

The processor 1332 may communicate with other internal and external components through input/output (I/O) circuitry 1331. The computing system 1330 may also include media drives 1336, such as hard and solid-state drives, CD-ROM drives, DVD drives, and other media 1338 capable of reading and/or storing information. In one embodiment, software for carrying out the operations at the computing system 1330 may be stored and distributed on CD-ROM, diskette, magnetic media, removable memory, or other form of media capable of portably storing information, as represented by media devices 1338. Such software may also be transmitted to the system 1330 via data signals, such as being downloaded electronically via a network such as the data network 1310, Local Area Network (LAN) (not shown), wireless network 1312, and/or any combination thereof. The storage/memory 1334 and/or media devices 1338 store the various programs and data used in connection with embodiments of the present disclosure. The illustrated computing system 1330 may also include DSP circuitry 1340, and at least one transceiver 1342 (which is intended to also refer to discrete transmitter/receiver components). The server 1330 and transceiver(s) 1342 may be configured to communicate with one or both of the fixed network 1310 and wireless network 1312.

Hardware, firmware, software or a combination thereof may be used to perform the functions and operations described herein. Using the foregoing specification, some embodiments of the disclosure may be implemented as a machine, process, or article of manufacture by using standard programming and/or engineering techniques to produce programming software, firmware, hardware or any combination thereof. Any resulting program(s), having computer-readable program code, may be embodied within one or more computer-usable media such as memory devices or transmitting devices, thereby making a computer program product, computer-readable medium, or other article of manufacture according to the invention. As such, the terms "computer-readable medium," "computer program product," or other analogous language are intended to encompass a computer program existing permanently, temporarily, or transitorily on any computer-usable medium such as on any memory device or in any transmitting device. From the description provided herein, those skilled in the art are readily able to combine software created as described with appropriate general purpose or special purpose computer hardware to create a computing system and/or computing subcomponents embodying various implementations of the disclosure, and to create a computing system(s) and/or computing subcomponents for carrying out the method embodiments of the disclosure.

Embodiments of a safety event alert system and methodology can be implemented in a wide variety of existing and future fleet management systems, such as those described in commonly owned U.S. Pat. No. 8,442,555 and US Published Patent Application No. 2012/0194679, which are hereby incorporated herein in their respective entireties.

It is to be understood that even though numerous characteristics of various embodiments have been set forth in the foregoing description, together with details of the structure and function of various embodiments, this detailed description is illustrative only, and changes may be made in detail, especially in matters of structure and arrangements of parts illustrated by the various embodiments to the full extent indicated by the broad general meaning of the terms in which the appended claims are expressed.

What is claimed is:

1. A method, comprising:

recording data at a plurality of in-service vehicles operating within a plurality of predetermined regions for which users of a plurality of mobile devices are responsible;

analyzing, at the vehicles, the recorded data for violation of one of a plurality of predetermined safety parameters by the vehicles;

transmitting, to a central server, data associated with a safety parameter violation by a vehicle in violation of one of the predetermined safety parameters;

authorizing the mobile devices for receiving safety event alerts associated with particular predetermined regions at the central server such that each mobile device is authorized for receiving safety event alerts associated with one or more of the particular predetermined regions but no other of the plurality of predetermined regions;

generating a safety event alert at the central server for the vehicle in violation in response to receiving the transmitted data;

determining, at the central server, which mobile device or devices are associated with the predetermined region within which the violation occurred; and communicating the safety event alert from the central server only to a mobile device authorized by the central server to receive the safety event alert for the predetermined region within which the violation occurred but to no other of the plurality of mobile devices.

2. The method of claim 1, wherein the method is implemented in substantially real-time.

3. The method of claim 1, wherein the safety event alert comprises a summary of the vehicle violation developed from the transmitted data received at the central server.

4. The method of claim 3, wherein the safety event alert comprises a summary of the vehicle violation developed from vehicle data indicative of driver behavior.

5. The method of claim 1, further comprising:

transmitting a request from the authorized mobile device to the central server for additional information about the vehicle violation.

6. The method of claim 5, further comprising:

transmitting from the central server to the authorized mobile device one or more of vehicle data, driver data, and geographical mapping data about the vehicle violation in response to the transmitted request.

7. The method of claim 1, further comprising:

transmitting from the authorized mobile device to the central server one or more of notes, action items, and calendar reminders generated by the authorized mobile device in response to the safety event alert.

8. The method of claim 1, further comprising:

transmitting from the authorized mobile device to the central server an instruction to dispatch a communication to the vehicle in violation perceivable by a driver of the vehicle in violation.

9. The method of claim 1, further comprising:

transmitting from the authorized mobile device to the central server an instruction to dispatch a communication about the vehicle violation to one or more remote electronic devices.

10. A system, comprising:

an onboard computing device configured for use at a vehicle operable within a plurality of predetermined regions for which users of a plurality of mobile devices are responsible, the onboard computing device comprising:

a wireless transceiver; and a processor configured to:

receive vehicle data from a vehicle computer system;

analyze the received vehicle data for violation of one of a plurality of predetermined safety parameters by the vehicle; and transmit data associated with a safety parameter violation by the vehicle via the wireless transceiver; and a central server configured to:

authorize the mobile devices for receiving safety event alerts associated with particular predetermined regions such that each mobile device is authorized for receiving safety event alerts associated with one or more of the particular predetermined regions but no other of the plurality of predetermined regions;

generate a safety event alert in response to receiving the data transmitted by the vehicle;

determine which mobile device or devices are associated with the predetermined region within which the violation occurred; and communicate the safety event alert only to one or more mobile devices authorized by the central server to receive the safety event alert for the predetermined region within which the violation occurred but to no other of the plurality of mobile devices.

11. The system of claim 10, wherein the safety event alert conforms to a Short Message Service (SMS) protocol.

12. The system of claim 10, wherein the safety event alert conforms to a Multimedia Messaging Service (MMS) protocol.

13. The system of claim 10, wherein predetermined safety parameters comprise at least sudden acceleration, sudden deceleration, and rollover stability.

14. The system of claim 10, wherein:

the processor comprises or is coupled to an event detector;

the event detector is configured to record received vehicle data for a predetermined period of time before and after a safety parameter violation; and the processor is configured to transmit the recorded data associated with the safety parameter violation to the central server via the wireless transceiver.

15. The system of claim 10, wherein the central server is configured to communicate additional information about the safety parameter violation to the one or more authorized mobile devices in response to a request generated by the one or more authorized mobile devices.

16. The system of claim 10, wherein the central server is configured to transmit a message generated by one of the authorized mobile devices to the onboard computing device of the vehicle in violation of the predetermined safety parameter.

17. The system of claim 10, wherein the central server is configured to communicate information about the safety parameter violation to one or more remote electronic devices in response to a request by the one or more authorized mobile devices.

18. A system, comprising:

a plurality of onboard computing devices configured for use at a plurality of vehicles operable within a plurality of predetermined regions for which users of a plurality of mobile devices are responsible, each of the onboard computing devices comprising:

a wireless transceiver; and a processor configured to:

receive vehicle data from a vehicle computer system;

analyze the received vehicle data for violation of one of a plurality of predetermined safety parameters by the vehicle; and transmit data associated with a safety parameter violation by the vehicle via the wireless transceiver; and a central server configured to:

communicate with each of the onboard computing devices;

receive data associated with the safety parameter violation transmitted by the onboard computing devices;

authorize the mobile devices for receiving safety event alerts associated with particular predetermined regions such that each mobile device is authorized for receiving safety event alerts associated with one or more of the particular predetermined regions but no other of the plurality of predetermined regions;

generate a safety event alert associated with each violating vehicle in response to the received data;

determine which of the mobile devices are authorized to receive the safety event alerts based on the predetermined regions within which the violations occurred; and communicate the safety event alerts only to the one or more authorized mobile devices but to no other of the plurality of mobile devices.

* * * * *